US009182699B2

(12) United States Patent
Yoshida

(10) Patent No.: US 9,182,699 B2
(45) Date of Patent: Nov. 10, 2015

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventor: Nobuyoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 13/659,188

(22) Filed: Oct. 24, 2012

(65) Prior Publication Data

US 2013/0108329 A1 May 2, 2013

(30) Foreign Application Priority Data

Oct. 28, 2011 (JP) ..... 2011-237525

(51) Int. Cl.
*G03G 15/08* (2006.01)
*G03G 15/01* (2006.01)

(52) U.S. Cl.
CPC ..... *G03G 15/0189* (2013.01); *G03G 15/0808* (2013.01); *G03G 2215/0132* (2013.01)

(58) Field of Classification Search
CPC ..... G03G 15/0812; G03G 15/0808; G03G 15/0832
USPC ..... 399/281
See application file for complete search history.

(56) References Cited

U.S. PATENT DOCUMENTS

| | | | | | |
|---|---|---|---|---|---|
| 5,701,563 | A | * | 12/1997 | Fukuda et al. | 399/284 |
| 5,749,026 | A | * | 5/1998 | Goldie | 399/106 |
| 2005/0117937 | A1 | | 6/2005 | Jeon | |
| 2007/0110470 | A1 | | 5/2007 | Takesawa | |

FOREIGN PATENT DOCUMENTS

| | | | |
|---|---|---|---|
| JP | H08-202150 | A | 8/1996 |
| JP | 10-153910 | A | 6/1998 |
| JP | 2003-173083 | A | 6/2003 |
| JP | 2005-173014 | A | 6/2005 |
| JP | 2010-039233 | A | 2/2010 |
| JP | 2010-117559 | A | 5/2010 |

* cited by examiner

*Primary Examiner* — Walter L Lindsay, Jr.
*Assistant Examiner* — Ruth Labombard
(74) *Attorney, Agent, or Firm* — Canon USA Inc. IP Division

(57) ABSTRACT

A developing device causes toner to be discharged from a foam layer by an intrusion member configured to intrude into the foam layer of a supply roller, and to be supplied to above a contact region between a developing roller and the supply roller.

11 Claims, 10 Drawing Sheets

-- PRIOR ART --

-- PRIOR ART --

DEVELOPING DEVICE, PROCESS CARTRIDGE, AND IMAGE FORMING APPARATUS

BACKGROUND OF THE INVENTION

1. Field of the Invention

The present disclosure relates to a developing device including an developer bearing member configured to bear a developer and a supply roller configured to supply the developer to the developer bearing member. This developing device can be used for an electrophotographic apparatus such as a printer and a copying machine.

2. Description of the Related Art

In image forming apparatuses such as printers using the electrophotographic image forming method (the electrophotographic process), an electrophotographic photosensitive member (hereinafter referred to as a "photosensitive member") as an image bearing member is evenly charged, and the charged photosensitive member is selectively exposed, whereby an electrostatic latent image is formed on the photosensitive member. The electrostatic latent image formed on the photosensitive member is visualized as a toner image by toner as a developer. Then, the toner image formed on the photosensitive member is transferred to a recording material such as recording paper and a plastic sheet, and further, heat and a pressure are applied to the toner image transferred onto the recording material to fix the toner image to the recording material, thereby performing image recording.

Generally, such image forming apparatuses require a replenish of the developer and maintenance of various kinds of process units. Assembling, for example, the photosensitive member, a charging unit, a developing unit, and a cleaning unit in a frame member to form a cartridge, and handling them as a process cartridge detachably attachable to a main body of the image forming apparatus are put into practical use to facilitate the developer replenish work and the maintenance of the various kinds of process units. According to the process cartridge method, it is possible to provide image forming apparatuses having excellent usability.

Further, in recent years, color image forming apparatuses, which form a color image using developers of a plurality of colors, have been widely used. As one type of color image forming apparatus, an in-line type image forming apparatus has been known. The in-line type image forming apparatus is configured in such a manner that photosensitive members corresponding to the respective image forming operations using developers of a plurality of colors are arranged in line along a surface movement direction of a member to be transferred to which a toner image is transferred. As the in-line type color image forming apparatus, there is an image forming apparatus including the plurality of photosensitive members arranged in line in a direction (for example, the horizontal direction) intersecting with the vertical direction (the direction of gravity). The in-line method is a desirable image forming method because, for example, it can easily satisfy demands such as speed-up of the image forming speed and development into a multifunction printer.

Further, as the in-line type image forming apparatus including the plurality of photosensitive members arranged in line in the direction intersecting with the vertical direction, Japanese Patent Application Laid-Open No. 2003-173083 discusses an image forming apparatus including the plurality of photosensitive members arranged below an intermediate transfer member as a member to be transferred or a recording material bearing member that conveys a recording material as a member to be transferred.

In a case where the photosensitive members are arranged below the intermediate transfer member or the recording material bearing member, for example, the fixing device and the developing device (or the exposure device) can be arranged away from each other with the intermediate transfer member or the recording material bearing member sandwiched therebetween within the main body of the image forming apparatus. This can provide such a benefit that the developing device (or the exposure device) becomes less affected by the heat of the fixing device.

On the other hand, in a case where the photosensitive members are arranged below the intermediate transfer member or the recording material bearing member as described above, the developing device may have to supply the developer to the developer bearing member and a supply roller against the gravity.

In this supply of the developer to the supply roller, it is most efficient to convey toner to a position immediately after a contact region (above the nip portion) between the developer bearing member and the supply roller in the rotational direction of the supply roller. This is because the supply roller includes an elastic layer having a plurality of cells on the outer circumference thereof, and the position immediately after the nip portion has such an effect that the cells are released from a pressure of the nip portion and are opened according thereto. The cells suck air at this time, thereby sucking the developer. Therefore, it is desirable to directly transmit the toner to this suction portion to make the supply roller hold the developer efficiently.

However, in the developing device that supplies the developer against the gravity, it is difficult to transmit a large amount of toner to the suction portion with a simple structure. Further, even if the toner can be transmitted to the vicinity of the suction portion, apart thereof can be sucked, but most of the toner is returned to, for example, a toner storage unit according to a rotation of the supply roller.

Therefore, Japanese Patent Application Laid-Open No. 2003-173083 discusses the technique for supplying the developer at the lower portion of the supply roller. In the technique discussed in Japanese Patent Application Laid-Open No. 2003-173083, the supply roller rotates upwardly at an abutment portion between the developing roller (the developer bearing member) and the supply roller (the developer supply member). Then, a toner receiving member is disposed below the supply roller. One end of a receiving sheet is attached to the toner receiving member, and this receiving sheet is brought into contact with the lower portion of the supply lower at an appropriate linear pressure.

In this way, Japanese Patent Application Laid-Open No. 2003-173083 discusses the method for bringing the receiving sheet into contact with the lower portion of the supply roller. According to this method, this receiving sheet prevents the developer attached to the supply roller from falling due to the gravity, prevents a reduction in the developer that can be supplied to the developing roller, and thereby prevents a reduction in the density of a solid image.

However, according to the developer supply method discussed in Japanese Patent Application Laid-Open No. 2003-173083, when images are formed at a low printing ratio in a row, the developer between the supply roller and the receiving sheet may stay for a long time without being consumed. In this case, the developer continues being supplied to between the supply roller and the receiving sheet according to a rotation of the supply roller, and the developer is coagulated there. As a result, the toner supply amount from the supply roller to the developing roller may become uneven, whereby an image may be formed at an uneven density.

SUMMARY OF THE INVENTION

The present disclosure is directed to a developing device, a process cartridge, and an image forming apparatus capable of preventing an image density from being reduced and becoming uneven.

According to an aspect disclosed herein, a developing device includes a developer bearing member configured to bear a developer, and a supply roller. The supply roller configures to include a foam layer on a surface thereof, and to rotate in contact with the developer bearing member to supply the developer to the developer bearing member, wherein the supply roller is configured to be disposed so a downstream end of a contact region between the supply roller and the developer bearing member in a rotational direction of the supply roller is situated higher than an upstream end of the contact region between the supply roller and the developer bearing member in the rotational direction of the supply roller. The developing device further includes a developer storage portion configured to be disposed lower, in a vertical direction, than the supply roller and to store the developer, a conveyance member configured to convey the developer stored in the developer storage portion to above the contact region, and an intrusion member intruding into the foam layer at a top of the supply roller, or at an upstream side relative to the top of the supply roller and a downstream side relative to the downstream end of the contact region in the rotational direction of the supply roller.

According to another aspect as disclosed herein, a developing device includes a developer bearing member configured to bear a developer, and a supply roller. The supply roller configures to include a foam layer on a surface thereof and to rotate in contact with the developer bearing member to supply the developer to the developer bearing member, wherein the supply roller is configured to be disposed so a downstream end of a contact region between the supply roller and the developer bearing member in a rotational direction of the supply roller is situated higher than an upstream end of the contact region between the supply roller and the developer bearing member in the rotational direction of the supply roller. The developing device further includes a developer storage portion configured to be disposed lower, in a vertical direction, than the supply roller and to store the developer, a conveyance member configured to convey the developer contained in the developer container portion to above the contact region, and an intrusion member intruding into the foam layer at a downstream side relative to a top of the supply roller and an upstream side relative to the upstream end of the contact region in the rotational direction of the supply roller, wherein an upper end of the intrusion member is situated higher, in the vertical direction, than the top of the supply roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles as disclosed herein.

DESCRIPTION OF THE EMBODIMENTS

Various exemplary embodiments, features, and aspects of the invention will be described in detail below with reference to the drawings.

Hereinafter, developing devices, process cartridges, and image forming apparatuses according to exemplary embodiments of the present invention will be described further in detail with reference to the drawings.

A first exemplary embodiment of the present disclosure will be described with reference to FIGS. 1 to 4.

Figure 1:
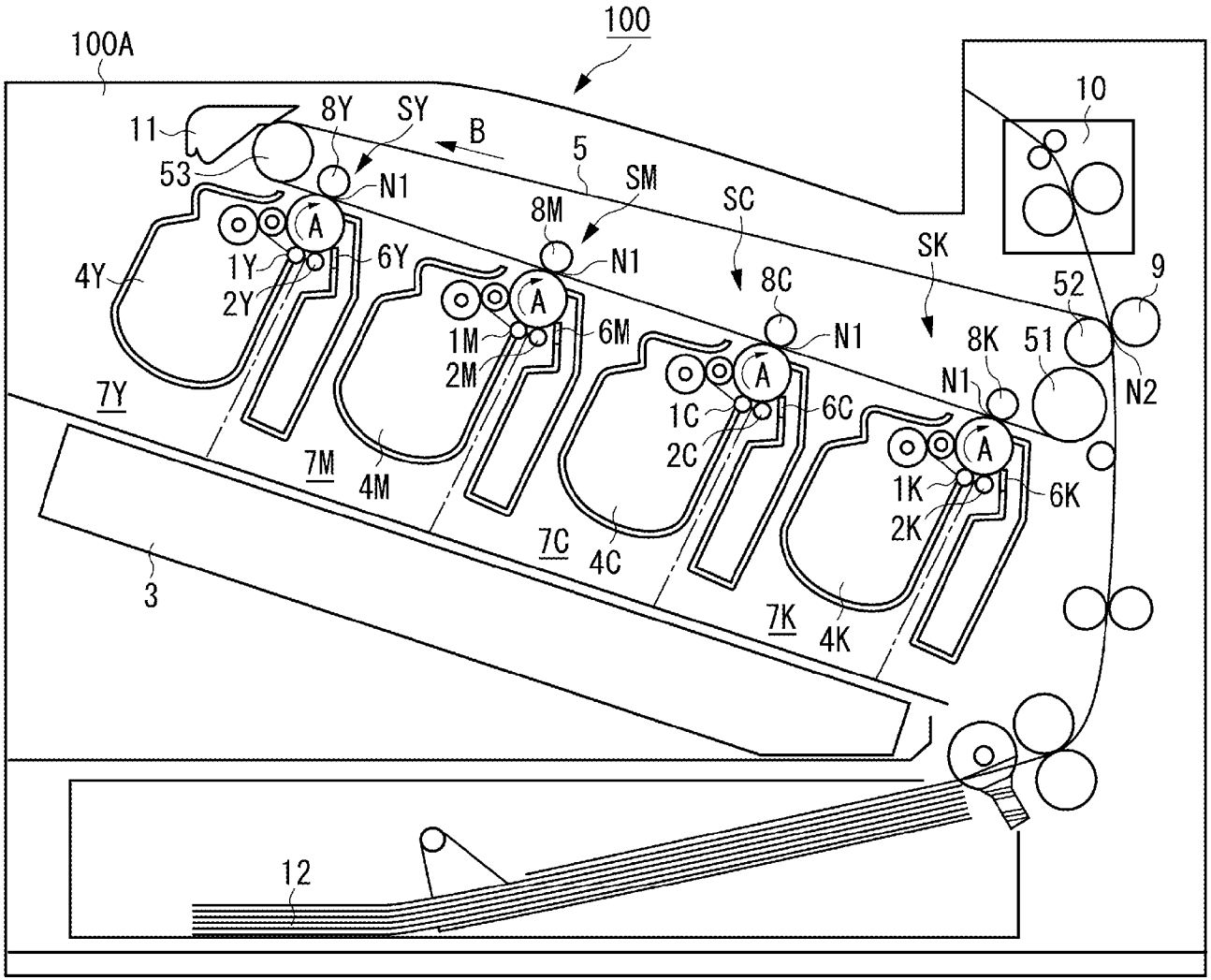
FIG. 1 is a cross-sectional view schematically illustrating the configuration of an image forming apparatus according to a first exemplary embodiment.

First, the entire configuration of an electrophotographic image forming apparatus (an image forming apparatus) according to the present exemplary embodiment of the present disclosure will be described. FIG. 1 is a cross-sectional view schematically illustrating an image forming apparatus 100 according to the present exemplary embodiment. The image forming apparatus 100 according to the present exemplary embodiment is a full color laser printer employing the in-line method and the intermediate transfer method. The image forming apparatus 100 can form a full color image on a recording material (for example, recording paper, a plastic sheet, and a cloth) according to image information. The image information is input from an image reading apparatus connected to an image forming apparatus main body 100A or a host apparatus such as a personal computer communicably connected to the image forming apparatus main body 100A, into the image forming apparatus main body 100A.

The image forming apparatus 100 includes first, second, third, and fourth image forming units SY, SM, SC, and SK for forming images of yellow (Y), magenta (M), cyan (C), and black (K) colors, respectively, as a plurality of image forming units. In the present exemplary embodiment, the first to fourth image forming units SY, SM, SC, and SK are arranged in line in a direction intersecting with the vertical direction.

In the present exemplary embodiment, the configurations and the operations of the first to fourth image forming units SY, SM, SC, and SK are substantially similar, except for the difference in the colors of images formed by them. Therefore, in the following description, the first to fourth image forming units SY, SM, SC, and SK will be collectively described while omitting the suffixes Y, M, C, and K, which are added to the reference numeral to indicate which color the element is provided for, unless it is especially necessary to distinguish them from one another.

In the present exemplary embodiment, the image forming apparatus 100 includes four drum-type electrophotographic photosensitive members i.e., photosensitive drums 1 arranged in parallel in the direction intersecting with the vertical direction, as a plurality of image bearing members. Each of the photosensitive drums 1 is driven to rotate by a not-illustrated driving unit (a driving source) in the direction indicated by the arrow A illustrated in the drawings (the clockwise direction).

A charging roller 2 and a scanner unit (an exposure device) 3 are disposed around the photosensitive drum 1. The charging roller 2 functions as a charging unit that evenly charges the surface of the photosensitive drum 1, and the scanner unit 3 functions as an exposure unit that forms an electrostatic image (an electrostatic latent image) on the photosensitive drum 1 by irradiating the photosensitive drum 1 with laser based on image information. Further, a developing unit (a developing device) 4 and a cleaning member 6 are disposed around the photosensitive drum 1. The developing unit 4 functions as a developing unit that develops the electrostatic image as a toner image, and the cleaning member 6 functions as a cleaning unit that removes toner (transfer residue toner) remaining on the surface of the photosensitive drum 1 after a transfer. Further, an intermediate transfer belt 5 is arranged to face the four photosensitive drums 1. The intermediate transfer belt 5 functions as an intermediate transfer member that transfers toner images on the photosensitive drums 1 to a recording material 12.

In the present exemplary embodiment, the developing unit 4 uses toner of a non-magnetic mono-component developer as a developer. In the present exemplary embodiment, the developing unit 4 performs reversal development by bringing a developing roller 17 (which will be described below) as a developer bearing member into contact with the photosensitive drum 1. Specifically, in the present exemplary embodiment, the developing unit 4 develops the electrostatic image by attaching toner charged to have the same polarity as a charge polarity of the photosensitive drum 1 (the negative polarity in the present exemplar embodiment) to a portion of the photosensitive drum 1 where the electric charge attenuates by the exposure (an image portion, an exposed portion).

In the present exemplary embodiment, the photosensitive drum 1, and the charging roller 2, the developing unit 4, and the cleaning member 6 as process units that work on the photosensitive drum 1 are integrated, i.e., are integrally assembled as a cartridge, thereby forming a process cartridge 7. The process cartridge 7 is detachably attachable to the image forming apparatus 100 via mounting units such as a mounting guide and a positioning member disposed at the image forming apparatus main body 100A. In the present exemplary embodiment, the process cartridges 7 for the respective colors are all identically shaped, and toners of the respective colors, yellow (Y), magenta (M), cyan (C), and black (K) are stored in the process cartridges 7 for the respective colors.

The intermediate transfer belt 5, which is made of an endless belt as an intermediate transfer member, abuts on all of the photosensitive drums 1, and circularly moves (rotates) in the direction indicated by the arrow B illustrated in the drawings (the counterclockwise direction). The intermediate transfer belt 5 is hung across a driving roller 51, a secondary transfer counter roller 52, and a driven roller 53 as a plurality of support members.

Four primary transfer rollers 8 are arranged in parallel as primary transfer units at the inner circumferential surface side of the intermediate transfer belt 5 opposed to the respective photosensitive drums 1. Each of the primary transfer rollers 8 presses the intermediate transfer belt 5 toward the photosensitive drum 1, thereby forming a primary transfer portion N1, where the intermediate transfer belt 5 and the photosensitive drum 1 abut on each other. Then, a bias having the reverse polarity of the normal charge polarity of the toner is applied to the primary transfer roller 8 from a primary transfer bias power source (a high-voltage power source) as a not-illustrated primary transfer bias application unit. As a result, the toner image on the photosensitive drum 1 is transferred (primarily transferred) onto the intermediate transfer belt 5.

Further, a secondary transfer roller 9 as a secondary transfer unit is arranged at the outer circumferential surface side of the intermediate transfer belt 5 at a position opposed to the secondary transfer counter roller 52. The secondary transfer roller 9 is in pressure contact with the secondary transfer counter roller 52 via the intermediate transfer belt 5, thereby forming a secondary transfer portion N2, where the intermediate transfer belt 5 and the secondary transfer roller 9 abut on each other. Then, a bias having the reverse polarity of the normal charge polarity of the toner is applied to the secondary transfer roller 9 from a secondary transfer bias power source (a high-voltage power source) as a not-illustrated secondary transfer bias application unit. As a result, the toner image on the intermediate transfer belt 5 is transferred (secondarily transferred) onto the recording material 12.

In addition, during image formation, first, the surface of the photosensitive drum 1 is evenly charged by the charging roller 2. Subsequently, the charged surface of the photosensitive drum 1 is scanned by and exposed to laser light emitted from the scanner unit 3 according to image information, whereby an electrostatic image is formed on the photosensitive drum 1 according to the image information. Subsequently, the electrostatic image formed on the photosensitive drum 1 is developed as a toner image by the developing unit 4. The toner image formed on the photosensitive drum 1 is transferred (primarily transferred) to the intermediate transfer belt 5 by an operation of the primary transfer roller 8.

For example, during formation of a full color image, the above-described process is performed at the first to fourth image forming units SY, SM, SC, and SK sequentially, and the toner images of the respective colors are superimposed on the intermediate transfer belt 5 one after another, thereby performing a primary transfer.

After that, the recording material 12 is conveyed to the secondary transfer unit N2 in synchronization with the movement of the intermediate transfer belt 5. The toner images of the four colors on the intermediate transfer belt 5 are collectively secondarily transferred onto the recording material 12 by an operation of the secondary transfer roller 9 abutting on the intermediate transfer belt 5 via the recording material 12.

The recording material 12 with the toner images transferred thereon is conveyed to a fixing device 10 as a fixing unit. Heat and a pressure are applied to the recording material 12 at the fixing device 10, whereby the toner images are fixed to the recording material 12.

Further, primary transfer residue toner, which remains on the photosensitive drum 1 after the primary transfer process, is removed and collected by the cleaning member 6. Further, secondary transfer residue toner, which remains on the intermediate transfer belt 5 after the secondary transfer process, is cleaned by an intermediate transfer belt cleaning device 11.

The image forming apparatus 100 can also form a monochrome image or a multicolor image by using only a desired single image forming unit or only several (not all) image forming units.

Figure 2:
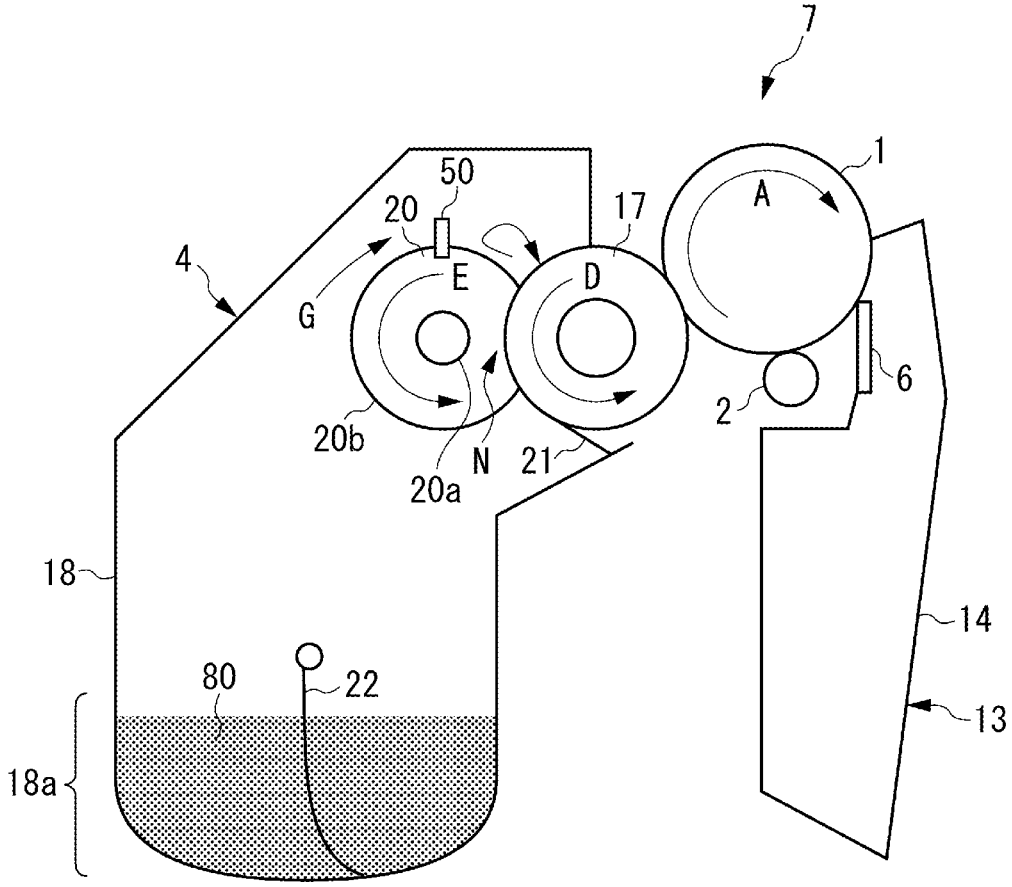
FIG. 2 is a cross-sectional view schematically illustrating the configurations of an exemplary embodiment of a developing device and a process cartridge according to the first exemplary embodiment.

Next, the entire configuration of the process cartridge 7 mounted on the image forming apparatus 100 according to the present exemplary embodiment will be described. FIG. 2 is a cross-sectional view (a main cross-sectional view) schematically illustrating the process cartridge 7 according to the present exemplary embodiment, as viewed along the longitudinal direction (the direction of the rotational axis) of the photosensitive drum 1.

In the present exemplary embodiment, the configurations and the operations of the process cartridges 7 for the respective colors are substantially similar, except for the types (colors) of the developers stored therein.

A photosensitive unit 13 including, for example, the photosensitive drum 1, and the developing unit 4 including, for example, the developing roller 17, are integrally assembled, thereby forming the process cartridge 7.

The photosensitive unit 13 includes a cleaning frame member 14 as a frame member that supports various kinds of elements within the photosensitive unit 13. The photosensitive drum 1 is rotatably installed in the cleaning frame member 14 via a not-illustrated bearing. A driving force of a driving motor as a not-illustrated driving unit (a driving source) is transmitted to the photosensitive unit 13, by which the photosensitive drum 1 is driven to rotate in the direction indicated by the arrow A illustrated in the drawings (the clockwise direction) according to an image forming operation. In the present exemplary embodiment, the photosensitive drum 1, which plays a main role in an image forming process, is embodied by an organic photosensitive drum 1 including an aluminum cylinder with the outer circumferential surface thereof sequentially coated with an under coat layer, a carrier generation layer, and a carrier transport layer, which are functional membranes.

Further, the photosensitive unit 13 includes the cleaning member 6 and the charging roller 2 arranged so as to come into contact with the circumferential surface of the photosensitive drum 1. The transfer residue toner removed from the surface of the photosensitive drum 1 by the cleaning member 6 is fallen and stored in the cleaning frame member 14.

The charging roller 2, which is the charging unit, is in pressure contact with the photosensitive drum 1 at its roller portion made of a conductive rubber, thereby being rotatably driven.

As the charging process, a predetermined direct current voltage with respect to the photosensitive drum 1 is applied to a core metal of the charging roller 2, whereby a dark potential (Vd) is evenly formed on the surface of the photosensitive drum 1. The photosensitive drum 1 is exposed to a laser light spot pattern according to image data, which is formed by laser light emitted from the above-described scanner unit 3. The exposed portion loses an electric charge on the surface by a carrier from the carrier generation layer, whereby the electric potential is reduced there. As a result, the exposed portion has a predetermined light portion potential (V1) while the unexposed portion has a predetermined dark portion potential (Vd), whereby an electrostatic latent image according thereto is formed on the photosensitive drum 1.

On the other hand, the developing unit 4 includes the developing roller 17 as the developer bearing member for bearing a developer (toner) 80, and a supply roller 20 as a developer supply member for supplying the toner 80 to the developing roller 17. Further, the developing unit 4 includes a toner storage chamber 18 for storing the toner 80. A toner storage portion 18*a* is formed in the toner container chamber 18 below the supply roller 20 in the direction of gravity. In the present exemplary embodiment, the longitudinal width of the developing unit 4 is 230 mm.

Further, the supply roller 20 rotates while coming into contact with the developing roller 17 with a nip portion N formed therebetween. The supply roller 20 rotates upwardly in the direction of gravity at the nip portion N (the downstream end of the nip portion N in the rotational direction of the supply roller 20 is located higher than the upstream end of the nip portion N in the rotational direction of the supply roller 20). Further, in the developing unit 4 according to the present exemplary embodiment, an intrusion member 50, which constitutes a characteristic feature of the present disclosure, is arranged so as to intrude into the supply unit 20 outside the nip portion N and near the downstream side in the rotational direction of the supply roller 20.

A stirring conveyance member 22 is disposed in the toner storage chamber 18. The stirring conveyance member 22 functions to stir the toner 80 stored in the toner storage portion 18*a*, and convey the toner 80 to above a contact region between the supply roller 20 and the developing roller 17 (in the direction indicated by the arrow G illustrated in the drawings). In the present exemplary embodiment, the stirring conveyance member 22 is driven to rotate at a speed of 30 rpm. In FIG. 2, the stirring conveyance member 22 rotates in the clockwise direction.

A developing blade 21 abuts on the developing roller 17 in the counter direction, and serves to regulate the coated amount of the toner 80 supplied by the supply roller 20 and apply an electric charge to the toner 80. The developing blade 21 is made of a thin plate-like member. The developing blade 21 forms an abutment pressure by utilizing the spring elasticity of the thin plate, and the surface thereof comes into contact with and abuts on the toner 80 and the developing roller 17. The toner 80 is frictionally charged to be provided with an electric charge, and at the same time, is regulated to have a certain layer thickness by a sliding friction between the developing blade 21 and the developing roller 17. Further, in the present exemplary embodiment, a predetermined voltage is applied from a not-illustrated blade bias power source to the developing blade 21, thereby stabilizing toner coating.

The developing roller 17 and the photosensitive drum 1 respectively rotate in such a manner that the surfaces thereof move in the same direction (the upward direction in the present exemplary embodiment) at a portion where they face each other (a contact portion).

In the present exemplary embodiment, the developing roller 17 is arranged so as to come into contact with the photosensitive drum 1, but the process cartridge 7 may be configured in such a manner that the developing roller 17 is arranged close to the photosensitive drum 1 with a predetermined space generated therebetween.

In the present exemplary embodiment, the toner 80 negatively charged by the friction charging with respect to a predetermined direct current (DC) bias applied to the developing roller 17 is transferred only to the light potential portion at a development portion where the developing roller 17 comes into contact with the photosensitive drum 1 due to the potential difference thereof, thereby visualizing the electrostatic latent image.

Figure 3:
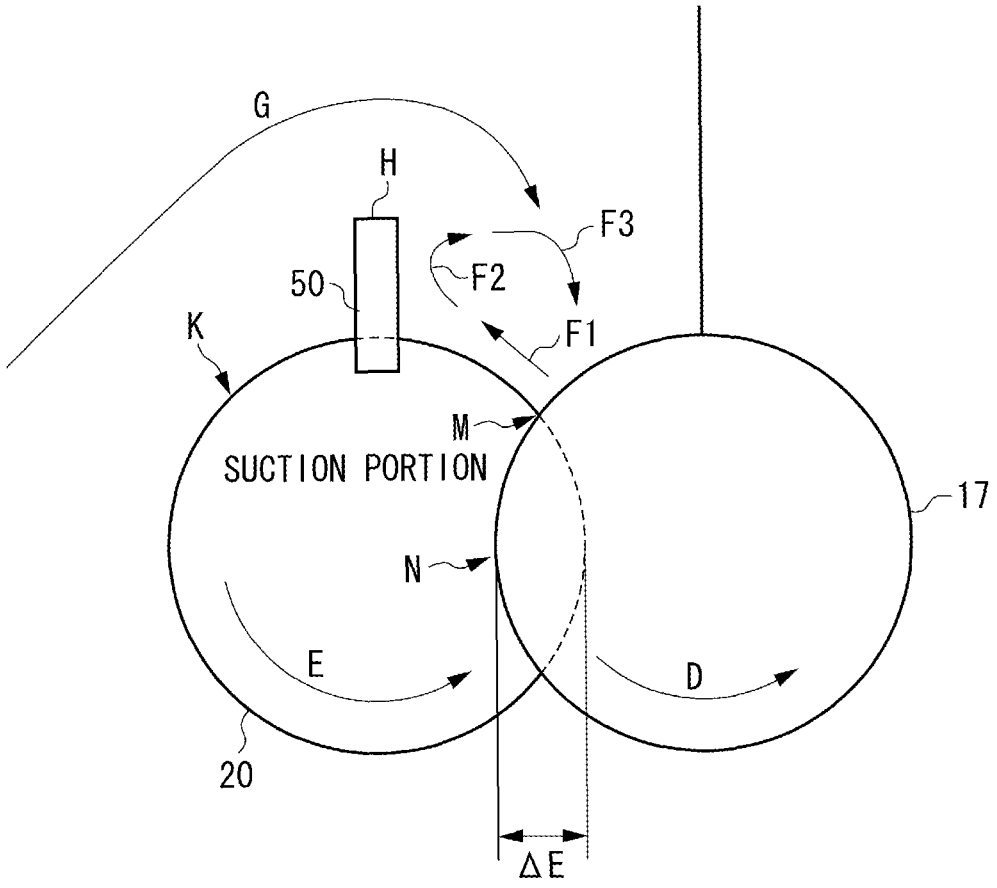
FIG. 3 is an enlarged cross-sectional view of the developing device to illustrate functions of an intrusion member according to the first exemplary embodiment.

The supply roller 20 is arranged so as to form the predetermined contact region (the nip portion) N on the circumferential surface of the developing roller 17 at the portion where the supply roller 20 and the developing roller 17 face each other, and rotates in the direction indicated by the arrow E illustrated in the drawings (the counterclockwise direction). The supply roller 20 is an elastic sponge roller including a foam layer formed on the outer circumference of the conductive core metal. The supply roller 20 and the developing roller 17 are brought into contact with each other with a predetermined intrusion amount, i.e., a recess amount ΔE by which the supply roller 20 is recessed by the developing roller 17, as illustrated in FIG. 3. The supply roller 20 and the developing roller 17 rotate so as to move in the opposing directions from each other at the contact region N. This operation allows the supply roller 20 to supply the toner 80 to the developing roller 17 and remove the toner 80 remaining as a development residue on the developing roller 17. In the present exemplary embodiment, the supply roller 20 is driven to rotate at a speed of 90 rpm, and the developing roller 17 is driven to rotate at a speed of 100 rpm.

In the present exemplary embodiment, both the outer diameters of the developing roller 17 and the supply roller 20 are 20 mm, and the amount of the intrusion of the supply roller 20 to the developing roller 17, i.e., the recess amount ΔE, by which the supply roller 20 is recessed by the developing roller 17, is set to 1.5 mm. Further, the supply roller 20 and the developing roller 17 are arranged so as to have a same center height.

Hereinafter, the supply roller 20 used in the present exemplary embodiment will be described in detail. The supply roller 20 in the present exemplary embodiment includes a conductive support member and a foam layer supported by the conductive support member. More specifically, the supply roller 20 includes a core metal electrode 20*a* as the conductive support member, and a foam urethane layer 20*b* as the foam layer formed around the core metal electrode 20*a*. The core metal electrode 20*a* has an outer diameter of ϕ5 (mm). The foam urethane layer 20*b* is constituted by a continuous bubble body (open cell) in which the bubbles are connected to one another. The supply roller 20 rotates in the direction indicated by the arrow E illustrated in the drawings. Further, the supply roller 20 used in the present exemplary embodiment has a longitudinal width of 220 mm.

The urethane on the surface layer is configured as a continuous bubble body, whereby a large amount of toner can be introduced within the supply roller 20. Further, the resistance of the supply roller 20 in the present exemplary embodiment is $1\times10^{9}$ (Ω).

Now, how to measure the resistance of the supply roller 20 will be described. The supply roller 20 is brought into abutment with an aluminum sleeve having a diameter of 30 mm so as to be intruded by 1.5 mm as an intrusion amount, which will be described below. This aluminum sleeve is controlled to rotate, whereby the supply roller 20 is rotatably driven at a speed of 30 rpm with respect to the aluminum sleeve.

Subsequently, a direct current voltage of −50 V is applied to the developing roller 17. At this time, a resistance of 10 kΩ is disposed at the earth side, and the voltages at the both ends thereof are measured to calculate a current, thereby calculating the resistance of the supply roller 20. In the present exemplary embodiment, the surface cell diameter and the porosity of the supply roller 20 are 50 μm to 1000 μm, and 0.6, respectively.

The term "cell diameter" here is defined to refer to the average diameter of foam cells in an arbitrary cross-section. First, the area of a maximum foam cell is measured from an enlarged image of an arbitrary cross-section. A diameter of a corresponding true circle is calculated from this area to acquire a maximum cell diameter. Foam cells equal to or smaller than a half of this maximum cell diameter are deleted as noises. After that, from the individual cell areas of remaining foam cells, individual cell diameters are similarly calculated to acquire an average value thereof, which is referred to as the "cell diameter". Further, the term "porosity" is defined to refer to a proportion of foam cells in an arbitrary cross-section. First, the areas of the respective foam cells are measured from an enlarged image of an arbitrary cross-section to acquire a total area of the foam cells. Then, the proportion of this total area of the foam cells in the arbitrary cross-section is calculated, and the resulting value thereof is referred to as the "porosity".

Next, the intrusion member 50, which is a characteristic feature of the present exemplary embodiment, will be described with reference to FIGS. 3 and 4. FIG. 3 is an enlarged cross-sectional view schematically illustrating the vicinity of a toner suction portion M of the supply roller 20, and illustrating the movement of the toner 80 conveyed to the supply roller 20 by the stirring conveyance member 22. The most efficient conveyance of the toner 80 by the stirring conveyance member 22 can be realized by conveying the toner 80 toward the toner suction portion M of the supply roller 20. At this time, the toner amount sucked by the supply roller 20 is largely affected by the intrusion amount of the supply roller 20 to the developing roller 17.

The intrusion amount of the supply roller 20 to the developing roller 17 is mainly determined by the performance of removing the toner 80 remaining on the developing roller 17 as the development residue. Therefore, if the supply roller 20 intrudes into the developing roller 17 by a large intrusion amount, the supply roller 20 supplies the toner 80 to the developing roller 17 by an amount larger than an amount actually required to coat the developing roller 17. In this case, the toner 80 that is not used in coating is directly returned to the developer storage portion 18*a*. The developer storage portion may be configured to be disposed lower, in a vertical direction (i.e. a direction approximately parallel with distance "h" as illustrated in FIG. 4), than the supply roller and to store the developer. To stably perform coating in this configuration, it is necessary to pump and convey a large amount of the toner 80 from the developer storage portion 18*a* by the stirring conveyance member 22 according to the intrusion amount of the supply roller 20 to the developing roller 17.

Therefore, in the present exemplary embodiment, the intrusion member 50, which intrudes into the foam layer, is disposed along the longitudinal direction of the supply roller 20. The intrusion member 50 is fixed to the frame member of the developing unit 4 at one end and the other end thereof in the longitudinal direction of the supply roller 20. Providing the intrusion member 50 can form a toner reservoir portion, which can reserve the toner 80, by the intrusion member 50, the supply roller 20, the developing roller 17, and the developing unit 4.

Figure 4:
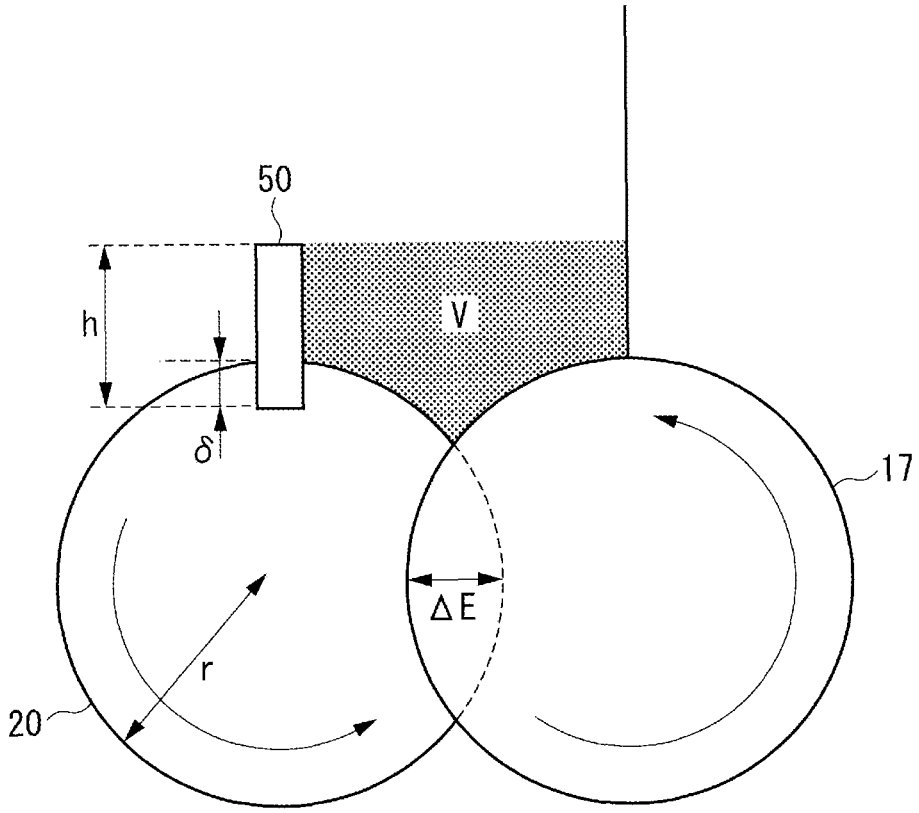
FIG. 4 is an enlarged cross-sectional view of the developing device to illustrate a volume V of a toner reservoir portion according to the first exemplary embodiment.

As illustrated in FIG. 4, the toner reservoir portion has a volume V determined by the upper end position of the intrusion member 50, and can reserve the toner 80. Owing to this configuration, the toner 80 conveyed to the vicinity of the toner suction portion M can be efficiently contained in the supply roller 20, and further, an excess amount of the toner 80 can be discharged by the intrusion member 50 to be returned to the toner reservoir portion. As a result, the toner 80 in the toner reservoir portion can be stably supplied to the developing roller 17 by only a required amount.

The functions of the intrusion member 50, which is a characteristic feature of the present exemplary embodiment, will be described. The toner 80 conveyed to the vicinity of the toner suction portion M by the stirring conveyance member 22 along the route indicated by the arrow G illustrated in the drawings is partially sucked in the suction portion M, and most of it is conveyed in the direction indicated by the arrow F1 illustrated in the drawings. There are two functions of the intrusion member 50. One of them is to bounce the toner 80 flowing in the direction indicated by the arrow F1 illustrated in the drawings without being contained in the supply roller 20 around the toner suction portion M to generate a toner circulation F (the circulation constituted by F1, F2, and F3), which transmits the toner 80 again to the vicinity of the toner suction portion M.

The other function is to cause the supply roller 20 to discharge an excess of the toner 80 therein to allow it to be utilized for development. At this time, the toner 80 discharged from the supply roller 20 holds a predetermined electric charge amount, and is circulated in the toner reservoir portion surrounded by the supply roller 20, the developing roller 17, the intrusion member 50, and the developing unit 4. More specifically, the intrusion member 50 can cause the toner 80 to be discharged from the foam layer to be supplied to the toner reservoir portion before the foam layer enters the nip portion N. Therefore, it becomes possible to reduce the toner 80 that falls from the nip portion N to the toner storage portion 18*a*. This function allows the toner 80 to be supplied to the toner supply member (the supply roller 20) by the stirring conveyance member 22 by only an amount required for the developing roller 17. As a result, it becomes possible to minimize a toner amount that the stirring conveyance member 22 conveys up (it becomes possible to reduce the conveyance force that the stirring conveyance member 22 should exert).

Further, it is desirable to arrange the intrusion member 50 in such a manner that the volume V of the toner storage portion satisfies the following relationship.

$$V>\pi*(\Delta E-\delta)(2R-\delta-\Delta E)*W*S*Trs/Ts$$

V: the volume of the toner reservoir portion

ΔE: the intrusion amount of the developing roller 17 to the foam layer

δ: the intrusion amount of the intrusion member 50 to the foam layer

R: the radius of the supply roller 20

W: the length of the foam layer in the longitudinal direction of the supply roller 20

S: the porosity of the supply roller 20

Trs: the number of rotations of the supply roller 20 per unit time

Figure 5:
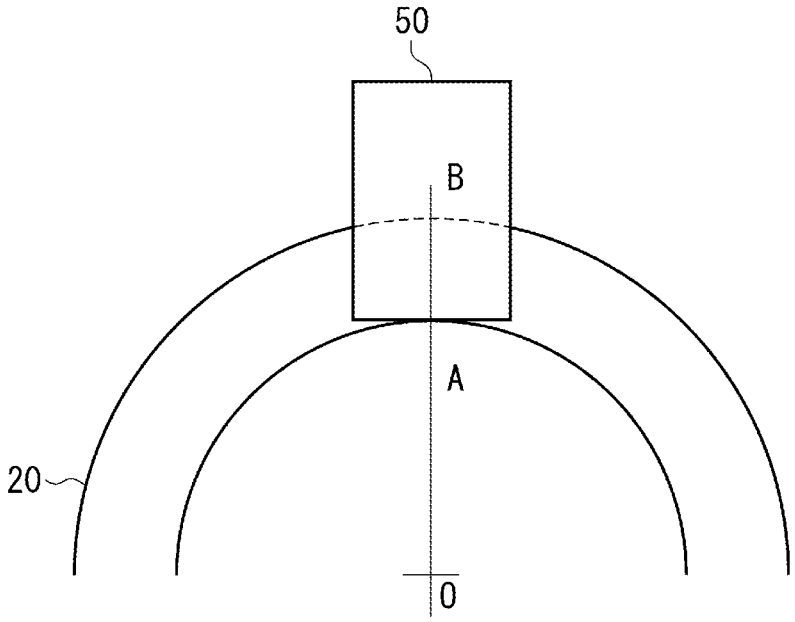
FIG. 5 is an enlarged cross-sectional view of the developing device to illustrate a definition of an intrusion amount by which the intrusion member intrudes into a foam layer according to the first exemplary embodiment.

Ts: the number of rotations of the stirring conveyance member 22 per unit time Where the intrusion amount δ of the intrusion member 50 to the foam layer is defined as δ=R-OA, where OA represents the shortest distance from a center O of the supply roller 20 to the intrusion member 50, as illustrated in FIG. 5.

Further, the intrusion amount ΔE of the developing roller 17 to the foam layer is defined as ΔE=P+R−M, where P represents the radius of the developing roller 17, and M represents the distance between the center of the developing roller 17 and the center of the supply roller 20. Next, the above-described equation will be described in detail.

A total C of a consumed toner amount and a toner amount fallen to the toner storage portion 18*a* when the toner supply member (the supply roller 20) completes one rotation without being intruded by the intrusion member 50 can be approximated to:

$$C=\{\pi R^2-\pi(R-\Delta E)^2\}*W*S$$

(because the toner 80 contained in the foam layer corresponding to the volume compressed by the nip portion N, among the toner 80 contained in the foam layer, is discharged to below the nip portion N).

Further, a toner amount D discharged to the toner reservoir portion by the intrusion member 50 when the toner supply member (the supply roller 20) completes one rotation while being intruded by the intrusion member 50 can be approximated to:

$$D=\{\pi R^2-\pi(R-\delta)^2\}*W*S$$

(because the toner 80 contained in the foam layer corresponding to the volume compressed by the intrusion member 50, among the toner 80 contained in the foam layer, is discharged to the toner reservoir portion V).

Therefore, a total E of the consumed toner amount and the toner amount dropped to the toner container portion 18*a* when the supply roller 20 completes one rotation while being intruded by the intrusion member 50 can be approximated to:

$$\begin{aligned} E &= C - D \\ &= \{\pi R^2 - (R-\Delta E)^2\} * W * S - \{\pi R^2 - \pi(R-\delta)^2\} * W * S \\ &= \pi(\Delta E - \delta)(2R - \delta - \Delta E) * W * S. \end{aligned}$$

The supply roller 20 has a Trs/Ts rotation during one rotation of the stirring conveyance member 22, whereby a total of the toner amount consumed by the supply roller 20 and the toner amount fallen to the toner storage portion 18*a* during one rotation of the stirring conveyance member 22 can be expressed by:

$$\pi(\Delta E-\delta)(2R-\delta-\Delta E)*W*S*Trs/Ts.$$

If this amount is smaller than the toner amount reserved in the toner reservoir portion V, it is possible to ensure that the toner 80 in the toner reservoir portion, which is conveyed up by one rotation of the stirring conveyance member 22, is supplied to the developing roller 17 by the supply roller 20 until the stirring conveyance member 22 conveys up the toner 80 next time.

In the present exemplary embodiment, the intrusion member 50 is embodied by a member 2.5 mm high, 2 mm thick, and 230 mm long in the longitudinal direction of the supply roller 20. This intrusion member 50 is placed so as to intrude into the supply roller 20 by 1 mm at the top of the supply roller 20. Further, it is desirable that the intrusion member 50 is harder than the foam layer of the supply roller 20. In the present exemplary embodiment, the intrusion member 50 is made of a stainless-steel plate.

Since the intrusion member 50 intrudes into the supply roller 20 by 1 mm, the upper end of the intrusion member 50 is situated 1.5 mm higher than the upper surface of the supply roller 20. Further, the wall surface of the developing unit 4 vertically extends from the top of the developing roller 17. At this time, the volume of the toner 80 reserved in the toner reservoir portion is 13.7 $cm^3$.

Further, in the present exemplary embodiment, since Trs=90 rpm, Ts=30 rpm, ΔE=1.5 mm, δ=1.0 mm, R=10 mm, S=0.6, and W=230 mm, the total of the toner amount conveyed and consumed by the supply roller 20 and the toner amount fallen to the toner storage portion 18*a* is 11.4 $cm^3$ during one rotation of the stirring conveyance member 22. Therefore, the toner amount reserved in the toner reservoir portion is larger than the total of the consumed toner amount and the toner amount fallen to the toner container portion 18*a* during one rotation of the stirring conveyance member 22, whereby it is possible to ensure that the supply roller 20 can supply the toner 80 to the developing roller 17.

Experiments were also conducted with the above-described conditions of the intrusion member 50 changed, i.e., using the intrusion member 50 having a height of 1.5 mm (the other conditions are not changed), or changing the intrusion amount of the intrusion member 50 to the tonner supply member (the supply roller 20) to 0.5 mm (the other conditions are not changed). However, the configuration of the present exemplary embodiment satisfying the above-described equation had the highest performance of following the density of a solid image.

As described above, the present exemplary embodiment allows the toner 80 to be supplied to the supply roller 20 efficiently owing to the provision of the intrusion member 50 at an appropriate position. Therefore, it is possible to provide a developing device, a process cartridge, and an image forming apparatus capable of improving the stability of the density of a solid image and offering a high-quality image.

Figure 6A:
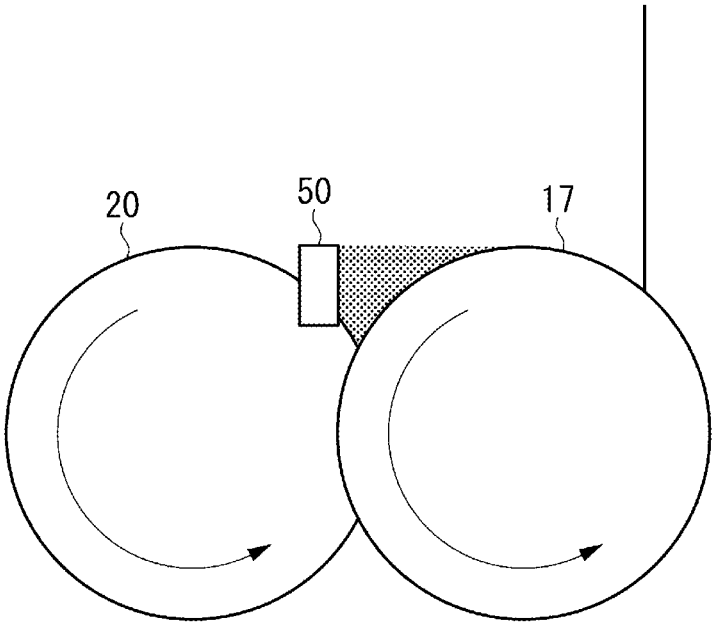
FIGS. 6A and 6B each illustrate an example of another arrangement of the intrusion member according to the first exemplary embodiment.
Figure 6B:
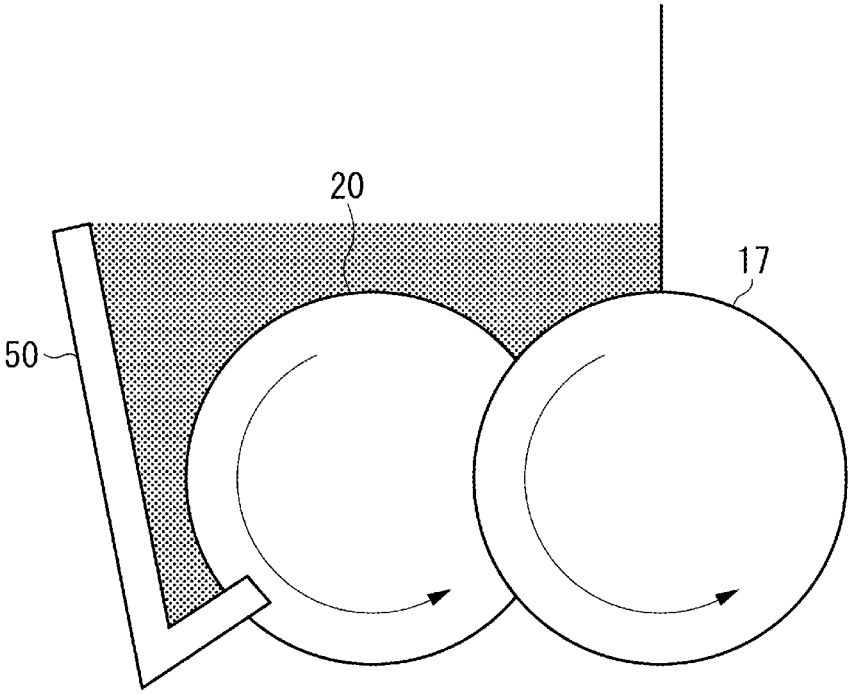

In the present exemplary embodiment, the intrusion member 50 is disposed to intrude at the top of the supply roller 20. However, the present invention is not limited thereto. As illustrated in FIG. 6A, the intrusion member 50 may be disposed to intrude at the upstream side relative to the top of the supply roller 20 in the rotational direction of the supply roller 20, and the downstream side relative to the downstream end of the nip portion N. Alternatively, as illustrated in FIG. 6B, the intrusion member 50 may be disposed to intrude at the downstream side relative to the top of the supply roller 20 in the rotational direction of the supply roller 20, and the upstream side relative to the upstream end of the nip portion N. It should be noted that, in the arrangement illustrated in FIG. 6B, it is desirable that the upper end of the intrusion member 50 is situated higher than the top of the supply roller 20. Owing to this configuration, the toner suction portion M of the supply roller 20 can be filled with the toner 80.

The advantageous effects of the present exemplary embodiment could be confirmed from a comparison with comparative examples, which will be described below.

Figure 7A:
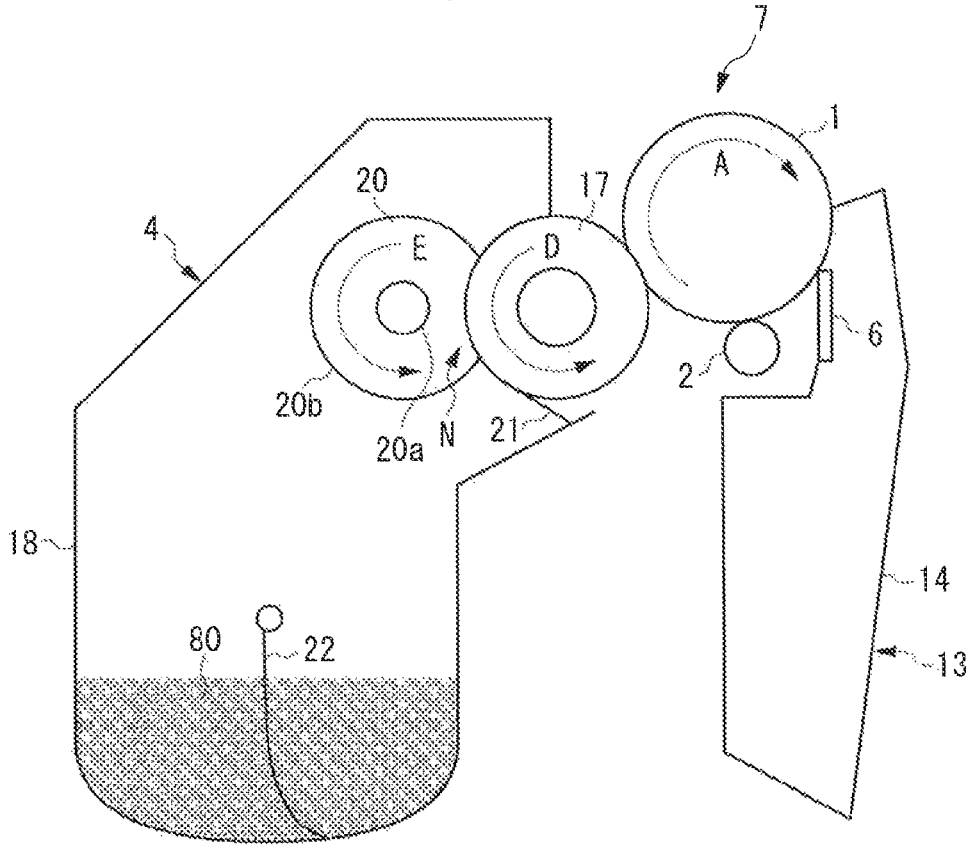
FIGS. 7A and 7B each schematically illustrate the configuration of a process cartridge according to a comparative example.

FIG. 7A is a cross-sectional view schematically illustrating a comparative example 1. As illustrated in FIG. 7A, a developing device 60 does not include the intrusion member 50. The other configuration is similar to the first exemplary embodiment.

Figure 7B:
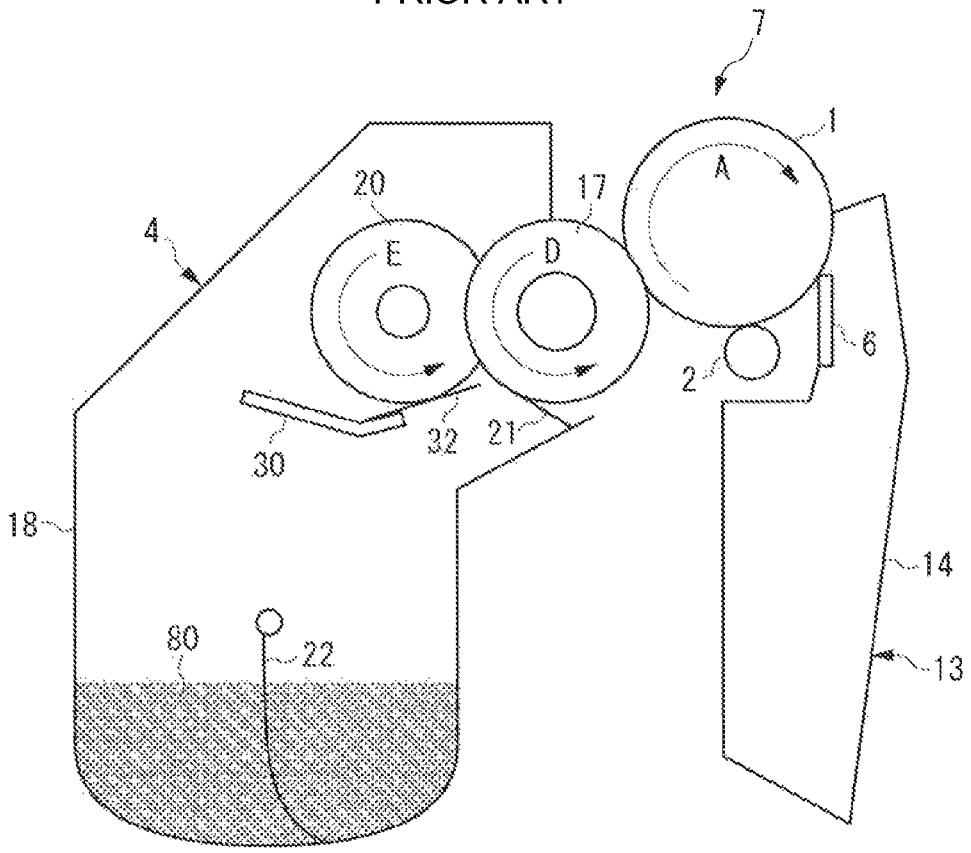

In a comparative example 2, the supply roller 20 rotates upwardly at the contact region between the developer bearing member 17 and the supply roller 20 in a similar manner to the above-described background art. Referring to FIG. 7B, a toner receiving member 30 is disposed below the supply roller 20. One end of a receiving sheet 32 is attached to the toner receiving member 30, and the receiving sheet 32 is brought into contact with the lower portion of the supply roller 20 at an appropriate linear pressure.

The following two experiments were conducted regarding the configuration of the present exemplary embodiment of the present disclosure.

(1) Evaluation of Performance of Following Density of Solid Image

The evaluation of the performance of following the density of a solid image, which measures how much the density is reduced after continuous execution of high-quality printing, was conducted as a comparison of toner supply performance.

The evaluation conditions were as follows. The image forming apparatus was placed for one day under an evaluation environment at a temperature of 25.0° C. and a relative humidity (Rh) of 50%, so that the image forming apparatus could get accustomed to this environment. After that, 100 sheets were printed by this image forming apparatus. Then, the evaluation was conducted. During the test of printing 100 sheets, a recorded image including horizontal lines at an image ratio of 5% was continuously printed. After that, three solid black images were output in a row, and then the following evaluation was conducted from the density difference between the output leading edge and the trailing edge of the third solid black image, with use of a Spectrodensitometer 500 manufactured by X-Rite, Incorporated. The printing test and the evaluated images were output as monochrome images.

A: In the solid black image, the density difference was less than 0.2 between the leading edge and the trailing edge of the sheet.

B: In the solid black image, the density difference was 0.2 or more and less than 0.3 between the leading edge and the trailing edge of the sheet.

C: In the solid black image, the density difference was 0.3 or more between the leading edge and the trailing edge of the sheet.

(2) Existence or Absence of Toner Coagulation

The evaluation of toner coagulation was performed by disassembling the image forming apparatus that had completed endurance, researching whether toner coagulation occurred in a development chamber, and conducting the following evaluation.

A: No toner coagulation occurred.

B: Toner coagulation occurred.

As conditions of the endurance, the image forming apparatus was placed under an environment at a temperature of 32.5° C. and a relative humidity of 80%, and 5000 sheets were intermittently printed by the image forming apparatus. Intermittent printing means printing a next sheet, via a waiting state, after the image forming apparatus prints a sheet.

The following table 1 indicates the settings of the present exemplary embodiment and the comparative examples 1 and 2, and the evaluation results thereof.

TABLE 1

| | DENSITY OF SOLID IMAGE | EXISTENCE OR ABSENCE OF TONER COAGULATION |
|---|---|---|
| FIRST EXEMPLARY EMBODIMENT | A | A |
| COMPARATIVE EXAMPLE 1 | C | A |
| COMPARATIVE EXAMPLE 2 | A | B |

In the comparative example 1, the toner 80 can be conveyed to the toner suction portion M by the stirring conveyance member 22, but the toner 80 not yet contained in the supply roller 20 is returned to the toner container portion 18*a* according to a rotation of the supply roller 20. Therefore, it is difficult to sufficiently contain the toner 80 in the supply roller 20, leading to an insufficient supply of the toner 80 to the developing roller 17. Toner coagulation does not occur in the comparative example 1.

Further, in the comparative example 2, the toner 80 is reserved on the toner receiving member 30 and the receiving sheet 32, thereby ensuring the density of a solid image. However, toner coagulation may occur between the receiving sheet 32 and the supply roller 20. Occurrence of toner coagulation may result in an uneven toner supply amount to the developing roller 17, leading to a possibility of unevenness in the image density.

On the other hand, in the present exemplary embodiment, the toner reservoir portion is formed at the toner suction portion M on the supply roller 20, thereby allowing the toner 80 to be efficiently contained in the foam layer. Therefore, the supply roller 20 can sufficiently hold the toner 80, thereby ensuring the density of a solid image. Further, no toner coagulation occurs, thereby preventing the density from becoming uneven due to toner coagulation.

The present exemplary embodiment is configured in such a manner that the intrusion member 50 is fixed to the frame member of the developing unit 4 at the one end side and the other end side of the intrusion member 50 in the longitudinal direction of the supply roller 20. However, the intrusion member 50 does not necessarily have to be a different member separated from the frame member of the developing unit 4. Specifically, the intrusion member 50 may be configured as a different body separated from the frame member of the developing unit 4, or may be constituted by the frame member of the developing unit 4 itself.

Next, a second exemplary embodiment will be described. As the second exemplary embodiment, a rotatable intrusion member 50 will be described. The first exemplary embodiment uses a fixed member as the intrusion member 50. However, in a case where the fixed member abuts on the supply roller 20, there is concern about an increase in the driving torque of the supply roller 20 and a breakage of the foam layer due to a fiction between the intrusion member 50 and the supply roller 20. Therefore, the present exemplary embodiment uses a rotatable roller as the intrusion member 50.

The image forming apparatus according to the present exemplary embodiment is configured in a similar manner to the first exemplary embodiment, and the description thereof will be omitted here as the description of the first exemplary embodiment is incorporated by reference.

Figure 8:
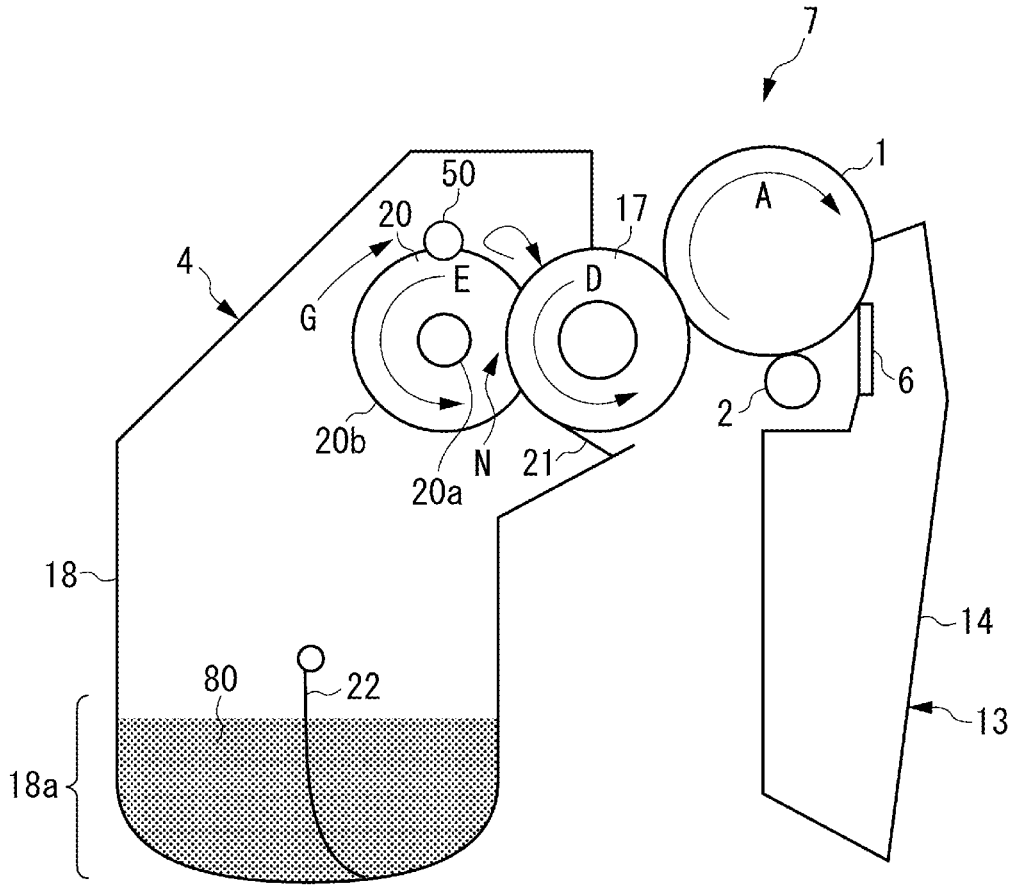
FIG. 8 schematically illustrates the configuration of a developing device and a process cartridge according to a second exemplary embodiment.

As illustrated in FIG. 8, the present exemplary embodiment uses a rotatable metallic roller $\phi$3 mm in diameter as the intrusion member 50. This intrusion member 50 is disposed to intrude into the supply roller 20 by 1 mm in a similar manner to the first exemplary embodiment, and is configured to be rotatably driven by the supply roller 20.

Figure 9:
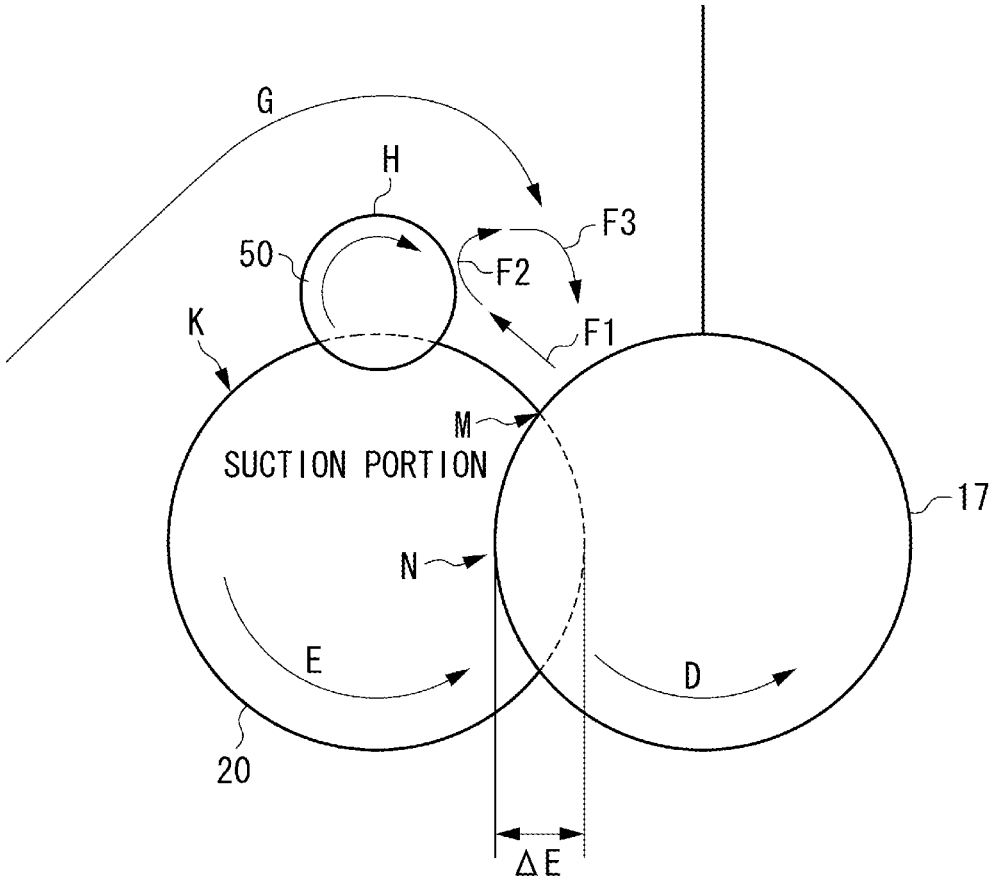
FIG. 9 is an enlarged cross-sectional view illustrating functions of an intrusion member according to the second exemplary embodiment.

Next, the functions of the intrusion member 50, which is a characteristic feature of the second exemplary embodiment, will be described with reference to FIG. 9. The toner 80 conveyed to the vicinity of the toner suction portion M by the stirring conveyance member 22 along the route indicated by the arrow G illustrated in the drawings is partially sucked in the suction portion M, and most of it is conveyed in the direction indicated by the arrow F1 illustrated in the drawings. There are two functions of the intrusion member 50. One of them is to bounce the toner 80 flowing in the direction indicated by the arrow F1 illustrated in the drawings without being contained in the supply roller 20 around the toner suction portion M to generate a toner circulation F (the circulation constituted by F1, F2, and F3), which transmits the toner 80 again to the vicinity of the toner suction portion M.

The other function is to cause the supply roller 20 to discharge an excess of the toner 80 therein to allow it to be utilized for development. At this time, the toner 80 discharged from the supply roller 20 holds a predetermined electric charge amount, and is circulated in the toner reservoir portion surrounded by the supply roller 20, the developing roller 17, the intrusion member 50, and the developing unit 4. More specifically, the intrusion member 50 can cause the toner 80 to be discharged from the foam layer to be supplied to the toner reservoir portion before the foam layer enters the nip portion N. Therefore, it becomes possible to reduce the toner 80 that falls from the nip portion N to the toner storage portion 18*a*. This function allows the toner 80 to be supplied to the toner supply member (the supply roller 20) by the stirring conveyance member 22 by only an amount required for the developing roller 17. As a result, it becomes possible to minimize a toner amount that the stirring conveyance member 22 conveys up (it becomes possible to reduce the conveyance force that the stirring conveyance member 22 should exert).

Further, the intrusion member 50 moves in the same direction as the supply roller 20 at the intrusion position where the intrusion member 50 intrudes into the foam layer (in other words, the intrusion member 50 rotates in the opposite direction from the supply roller 20), thereby reducing a sliding friction force between the intrusion member 50 and the foam layer to realize prevention of a breakage of the foam layer and accomplish a reduction in the driving torque of the supply roller 20. Further, the intrusion member 50 is rotatably driven by the supply roller 20, thereby further reducing a sliding friction force between the intrusion member 50 and the foam layer to realize prevention of a breakage of the foam layer and accomplish a reduction in the driving torque of the supply roller 20. Further, the intrusion member 50 has a curved shape at the portion where the intrusion member 50 intrudes into the foam layer (the intrusion member 50 in the present exemplary embodiment has a cylindrical shape, and is disposed so as to intrude into the foam layer in the radial direction of the cylindrical shape), thereby further reducing a sliding friction force between the intrusion member 50 and the foam layer to realize prevention of a breakage of the foam layer and accomplish a reduction in the driving torque of the supply roller 20.

As described above, use of the intrusion member 50 according to the present exemplary embodiment enables prevention of a breakage of the foam layer and facilitates a reduction in the driving torque of the supply roller 20, and at the same time, allows the supply roller 20 to efficiently hold the toner 80 conveyed by the stirring conveyance member 22. Therefore, it is possible to provide a developing device, a process cartridge, and an electrophotographic image forming apparatus capable of improving the stability of the density of a solid image and offering a high-quality image.

The configuration according to the present exemplary embodiment was tested by similar experiments to the experiments conducted for the first exemplary embodiment. As a result, it can be confirmed that the present exemplary embodiment can also provide similar advantageous effects to the advantageous effects of the first exemplary embodiment.

The first and second exemplary embodiments have been described above. These exemplary embodiments are based on an example of an image forming apparatus capable of forming a color image, but the present invention is not limited thereto. The present invention can be applied to an image forming apparatus capable of forming a monochrome image. Employing the present invention to a developing device of such an image forming apparatus can provide similar advantageous effects.

Further, the above-described exemplary embodiments have been described based on an example using a printer as an image forming apparatus, but the present invention is not limited thereto. The present invention can be employed to, for example, another type of image forming apparatus such as a copying machine or a facsimile apparatus, another type of image forming apparatus such as a multifunction peripheral having all of the functions of these apparatuses, and an image forming apparatus using a recording material bearing member, and transferring toner images of the respective colors while sequentially superimposing them on a recording material borne by the recording material bearing member.

Employing the present invention to a developing device of any of such image forming apparatuses can provide similar advantageous effects.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-237525 filed Oct. 28, 2011, which is hereby incorporated by reference herein in its entirety.

What is claimed is:

1. A developing device comprising:

a developer bearing member configured to bear a developer;

a supply roller configured to include a foam layer on a surface thereof, and to rotate in contact with the developer bearing member to supply the developer to the developer bearing member;

a developer storage portion configured to be disposed lower, in a vertical direction, than the supply roller and to store the developer;

a conveyance member configured to convey the developer stored in the developer storage portion by transmitting the developer toward a contact region where the supply roller and the developer bearing member are in contact with each other; and an intrusion member intruding into the foam layer at a top of the supply roller, or at an upstream side relative to the top of the supply roller and a downstream side relative to a downstream end of the contact region in a rotational direction of the supply roller in order that the developer passed through the contact region is circulated by the intrusion member at a vicinity of the contact region.

2. The developing device according to claim 1, wherein the intrusion member has a curved shape at a portion where the intrusion member intrudes into the foam layer.

3. The developing device according to claim 1, wherein the intrusion member rotates in an opposite direction from the rotational direction of the supply roller.

4. The developing device according to claim 1, wherein the intrusion member is rotatably driven by the supply roller.

5. The developing device according to claim 1, wherein the intrusion member has a cylindrical shape, and is disposed so as to intrude into the foam layer in a radial direction of the cylindrical shape of the intrusion member.

6. The developing device according to claim 1, wherein a reservoir portion, which is formed by the developer bearing member, the supply roller, and the intrusion member above the contact region, has a volume V for reserving the developer, and the volume V of the developer storage portion satisfies the following condition:

$$V>\pi*(\Delta E-\delta)(2R-\delta\Delta E)*W*S*Trs/Ts$$

where ΔE represents an intrusion amount in millimeters (mm) by which the developer bearing member intrudes into the foam layer, δ represents an intrusion amount (mm) by which the intrusion member intrudes into the foam layer, R represents a radius (mm) of the supply roller, W represents a length (mm) of the foam layer in a longitudinal direction of the supply roller, S represents a porosity of the foam layer, Trs represents a number of rotations of the supply roller per unit time in revolutions per minute (rpm), and Ts represents a number of rotations of the conveyance member per unit time (rpm).

7. A process cartridge detachably attachable to a main body of an image forming apparatus, the process cartridge comprising:

an image bearing member configured to bear an electrostatic latent image; and the developing device according to claim 1.

8. An image forming apparatus configured to form an image on a recording material, the image forming apparatus comprising:

an image bearing member configured to bear an electrostatic latent image;

the developing device according to claim 1; and a conveyance unit configured to convey the recording material.

9. The developing device according to claim 1, wherein the supply roller is configured to be disposed so the downstream end of the contact region in the rotational direction of the supply roller is situated higher than an upstream end of the contact region between the supply roller and the developer bearing member in the rotational direction of the supply roller.

10. The developing device according to claim 1, wherein the intrusion member intrudes into the foam layer at a downstream side relative to a top of the supply roller and an upstream side relative to the upstream end of the contact region in the rotational direction of the supply roller, wherein an upper end of the intrusion member is situated higher, in the vertical direction, than the top of the supply roller.

11. The developing device according to claim 1, wherein the conveyance member conveys the developer toward the contact region by transmitting the developer above an upper end of the supply roller.

* * * * *